US005918770A

United States Patent [19]

Camm et al.

[11] Patent Number: 5,918,770

[45] Date of Patent: Jul. 6, 1999

[54] DUAL MATERIAL DISPENSER COMPRISING TWO CONTAINERS IN HEAD TO TAIL ARRANGEMENT

[76] Inventors: James Owen Camm, 51 Millewa Ave., East Malvern, Australia, 3148; Stephen John Camm, 19 Quixley Crescent, Wantirna, Australia, 3152

[21] Appl. No.: 08/894,692

[22] PCT Filed: Feb. 26, 1996

[86] PCT No.: PCT/AU96/00100

§ 371 Date: Aug. 26, 1997

§ 102(e) Date: Aug. 26, 1997

[87] PCT Pub. No.: WO96/26869

PCT Pub. Date: Sep. 6, 1996

[30] Foreign Application Priority Data

Feb. 27, 1995 [AU] Australia ..... PN1404
Sep. 11, 1995 [AU] Australia ..... PN5344

[51] Int. Cl.[6] ..... B65D 81/32; B65D 83/76

[52] U.S. Cl. ..... 222/135; 222/137

[58] Field of Search ..... 222/129, 135, 222/136, 137, 326, 327, 386

[56] References Cited

U.S. PATENT DOCUMENTS

| | | | |
|---|---|---|---|
| 3,164,303 | 1/1965 | Trautmann | 222/136 X |
| 3,370,754 | 2/1968 | Cook et al. | 222/136 X |
| 3,735,900 | 5/1973 | Gores | 222/386 X |
| 4,014,463 | 3/1977 | Hermann | 222/135 |
| 4,220,261 | 9/1980 | White | 222/135 |
| 4,366,919 | 1/1983 | Anderson | 222/137 |
| 4,526,295 | 7/1985 | Morel et al. | 222/137 X |
| 4,834,714 | 5/1989 | Lascar et al. | 222/135 X |

FOREIGN PATENT DOCUMENTS

| | | |
|---|---|---|
| A-57514/94 | 11/1994 | Australia . |
| 0 282 871 | 9/1988 | European Pat. Off. . |
| 0 336 916 | 4/1989 | European Pat. Off. . |
| 0 335 763 | 10/1989 | European Pat. Off. . |
| 2418173 | 9/1979 | France . |

*Primary Examiner*—Kevin P. Shaver
*Attorney, Agent, or Firm*—Larson & Taylor

[57] ABSTRACT

A dispenser which comprises first and second containers connected together in a head to tail arrangement by screw threads. The first container has a piston therein for dispensing material from the first container. The second container has a piston therein for dispensing material from the second container The piston of the first container includes a push rod which engages and moves the piston disposed within the second container when the piston of the first container is moved.

25 Claims, 9 Drawing Sheets

DUAL MATERIAL DISPENSER COMPRISING TWO CONTAINERS IN HEAD TO TAIL ARRANGEMENT

This invention relates to a dispenser and, in particular, to a dispenser for dispensing two different components which are not mixed until the components are dispensed from the dispenser.

Dispensers for dispensing materials and, in particular, viscous materials, are known. Such dispensers usually include a container in which the material is located. A piston is located in the container and is moved within the container to force the viscous material out of the container. Dispensers are also known which include dual containers for dispensing different materials. Each container is provided with a piston and the pistons are interengaged so that they move at the same rate so that a predetermined ratio of the materials with respect to one another can be dispensed.

It is also known to arrange one container within the other. It is also known to arrange the two containers in a generally side by side arrangement. It is also known to interengage the two pistons, one piston being in each container as is disclosed in our co-pending international patent application PCT/AU92/00287 the contents of which is incorporated herein by this reference.

The object of the present invention is to provide a two component dispenser which is easier to manufacture, fill, assemble and use.

The invention may be said to reside in a dispenser, including:

a first container for containing a first material, a first end on the first container;

a first piston arranged in the first container for movement towards the first end for dispensing the first material from the container;

a second container for containing a second material, a second end on the second container;

a second piston arranged in the second container for movement away from the second end for dispensing the second material from the second container, the second container being arranged relative to the first container such that the second end is in the proximity of and fixed relative to the first end; and interengaging means arranged between the first and second pistons such that when the first piston is moved, the second piston is moved by the interengaging means which extends between the first and second pistons.

Preferably the second container is of smaller diameter than the first container and the first container being dimensioned to fit within a hand dispenser gun so that an actuator of the hand dispenser gun can push the first piston towards the first end of the first container to, in turn, cause the interengaging means to push the second piston in the second container away from the second end of the second container to dispense the first material from the first container and the second material from the second container.

Preferably the interengaging means comprises a rod between the first and second pistons.

The invention also provides a dispenser including:

a first container for containing a first material, the first container having a first end and a second end;

a first outlet from the first container;

a piston in the first container for movement away from the second end and towards the first end to dispense the first component from the first container through said first outlet;

a push member coupled to the first container and moveable relative to the first container when the first piston is moved away from the second end towards the first end;

a second container for containing a second material, the second container having a first end and a second end;

a second outlet from the second container;

a second piston in the second container for movement away from the second end of the second container and towards the first end of the second container to dispense the second material from the second container through said second outlet, the second piston being separate from the first piston and the push member;

a coupling means at the first end of the first container or second end of the second container for engaging another coupling means so that the first and second containers can be held in a head to tail arrangement so that when the first piston is moved and the push member is moved, the push member can engage the second piston to move the second piston so that the first and second materials are dispensed from the dispenser.

Preferably the coupling means is a first coupling means at the first end of the first container, and the said another coupling means is a second co-operating coupling means at the second end of the second container.

Preferably the coupling means is a first coupling means at the first end of the first container, and the said another coupling means is included in a stand for supporting the dispenser so that the another coupling means and first coupling means co-operate to couple the first and second container in head to tail arrangement.

Preferably the first coupling means comprises a screw thread at the first end of the first container and the second coupling means comprises a co-operating screw thread at the second end of the second container for screw thread engagement with the first screw thread to thereby couple the first and second containers in head to tail arrangement.

Preferably an outlet tube is coupled to the second container, the outlet tube having first and second ends, the first end of the outlet tube having said first outlet for enabling dispensing of the first material, the second end of the outlet tube having an inlet opening for communication with the first container so that the first material can pass from the first container into the inlet opening, through the outlet tube and out of the first outlet.

Preferably the second outlet of the second container is arranged at the first end of the second container.

Preferably the first and second outlets are substantially aligned with one another so that the first and second materials can be dispensed from the first and second outlets onto a substrate and mixed together.

In a second embodiment, the dispenser is a larger industrial dispenser rather than a dispenser for use with a hand gun.

In this embodiment, the dispenser includes a stand having a first valve for connection with the first outlet, the stand supporting the second container and holding it fixed relative to the first container, the stand having a second valve for communication with the second outlet.

Preferably the coupling means comprises a screw thread on the first container and the another coupling means comprises a screw threaded nut for engaging the screw thread of the first container to couple the first container and second container together in head to tail arrangement.

The invention also provides a first container for a dual material dispenser including a second container for containing a second material, the second container having a second piston, the first container including:

a container body for containing a first material, the container body having a first end, a second end, and a base at the first end;

a first outlet from the container body;

a piston in the container body for movement away from the second end and towards the first end to dispense the first component from the container body through said first outlet;

a push member moveable relative to the container body when the first piston is moved away from the second end towards the first end; and wherein the container is fixable relative to the second container in a head to tail arrangement so that when the first piston is moved and the push member is moved, the push member can engage the second piston in the second container to move the second piston so that the first and second materials are dispensed from the first and second containers.

The invention also provides a stand for a dispenser having an outlet, including:

a valve for controlling egress of material from the dispenser;

coupling means for coupling the valve to the outlet; and support means attached to the valve and the coupling means for supporting the dispenser aloft.

The invention also provides a second container for a dual dispenser including a first container for containing a first material, a first piston, a push member for movement with the first piston and a first outlet, the second container including:

a second container body for containing a second material, the container body having a first end and a second end;

a second outlet for the second container body;

a second piston in the second container body for movement away from the second end and towards the first end to dispense the second material through the second outlet; and coupling means at the second end of the second container body for coupling the second container body to the first container in a head to tail arrangement so that when the push member is moved with the first piston in the first container, the push member can engage the second piston to move the second piston so the first and second materials are dispensed from the first container and second container.

The invention also provides a container for a dual material dispenser, including:

a container body for containing a first material, the container body having a first end, a second end, and a base at the first end;

a first outlet from the container body;

a piston in the container body for movement away from the second end and towards the first end to dispense the first component from the container body through said first outlet;

alignment means for receiving a push member to maintain the push member in alignment substantially with the direction of movement of the piston; and wherein the container is fixable relative to a second container, for containing a second material, in a head to tail arrangement so that when the first piston is moved the push member is held in alignment by the alignment means.

Preferred embodiments of the invention will be described, by way of example, with reference to the accompanying drawings, in which.

Figure 1:
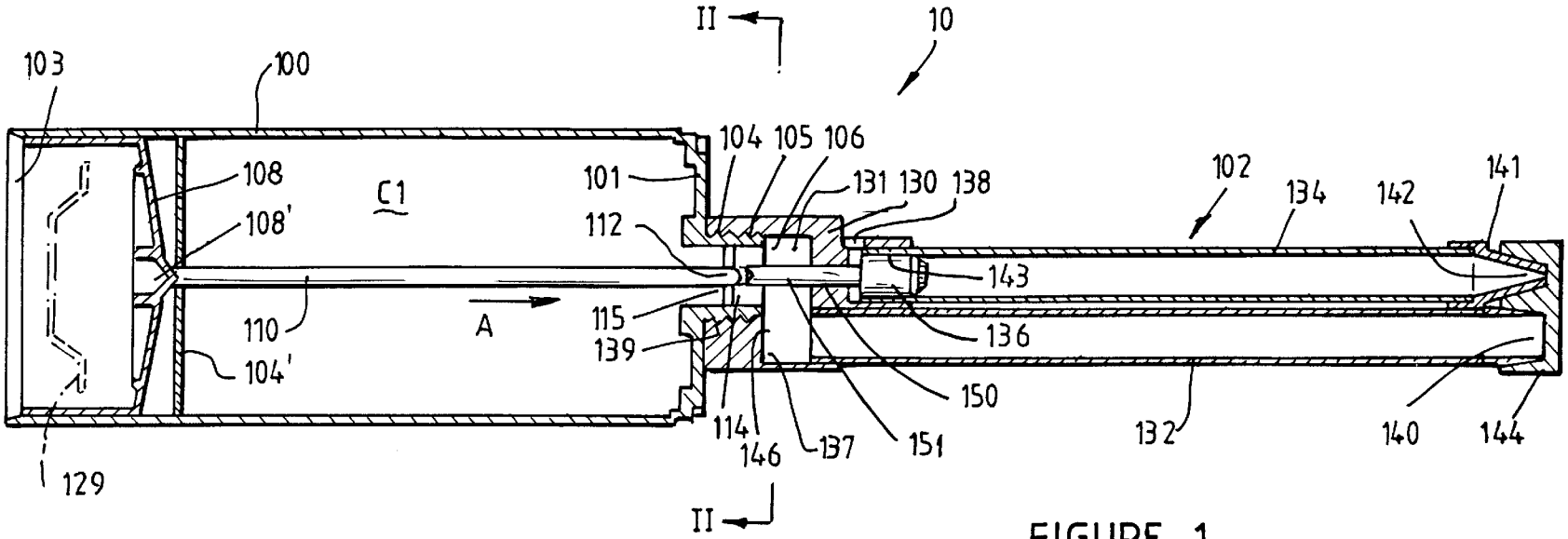
FIG. 1 is a cross-sectional view through a dispenser according to the first embodiment of the invention.

With reference to FIG. 1, a dispenser 10 is shown which comprises a first container 100, which has a first end 101 and a second end 103. The first end 101 has a reduced diameter projecting portion 104 which is provided with an external screw thread 105. The reduced diameter portion 104 has an integral end cap 106 which is adapted to be cut from the reduced projecting portion 104 to gain access to a first material C1 located in the dispenser 100.

The dispenser 100 has a first piston 108 which is arranged at the second end 103 of the container 100 when the container 100 is filled with the first material C1.

An insert 114 is arranged within the reduced diameter portion 104. The insert 114 has a central hole 115 for receiving a push rod 110. In the initial position of the dispenser as shown in FIG. 1, the push rod 110 extends from the insert 114 to the piston 108 and engages with a point or projection 108' on the piston 108. The point or projection 108' assists to align the rod 110 to eliminate the tendency to slip sideways off the face of the piston.

Figure 2:
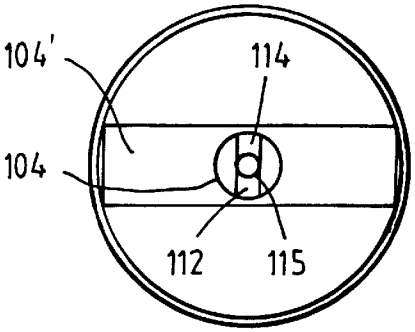
FIG. 2 is a view along the line II—II of FIG. 1.

The insert 114 extends across the reduced diameter portion 104 as is best seen in FIG. 2 but is dimensioned so as to place no substantial restriction on the flow of component C1 through the reduced diameter portion 104 for the reasons which will become apparent hereinafter. An insert 104' is also arranged adjacent to the piston 108 for supporting the rod 110 centrally in container 100. The insert 104' will move with piston 108 when the piston 108 contacts insert 104'. The piston 108 has a point or projection 108' which locates in a recess in the end of the rod 110 to further assist in the alignment of the rod 110 to further eliminate the tendency of the rod 110 to slip sideways off the face of the piston 108. As shown the rod 110 is aligned substantially parallel to the direction of movement of the piston 108.

A second container assembly 102 has an attachment base 130 which has an eccentrically located bore 131. The bore 131 is provided with an internal screw thread 139 for engaging the screw thread 105 on the reduced diameter portion 104 of the first container 100. A second container 134 is coupled to the base 130 by, for example gluing, so that the second container 134 is aligned with the bore 131 and with reduced diameter portion 104 and the push rod 110 when the assembly 102 is attached to the container 100. The second container 134, which contains a second material C2, has a first end 141 and a second end 143. A piston 136 is arranged at the second end 143 of the second container 134 when the dispenser is in its initial configuration as shown in FIG. 1. The piston 136 has a stem 151 which projects through a hole 150 in the connecting base 130. The stem 151 and hole 150 are dimensioned to be a tight fit to effectively form a seal therebetween. Alternatively, an O-ring (not shown) could be provided in a groove (not shown) in the hole 150 for providing a seal.

An outlet tube 132 is arranged generally parallel to the second container 134 and is also fixed to the base 130 by an inlet end 137 being glued in a cavity 146 in the base 130. The cavity 146 communicates with the bore 131.

The second container assembly 102 is provided with a second outlet 142 at the first end 141 and a first outlet 140 for the first container 100 is provided at the end of outlet tube 132. Thus, first and second outlets 142 and 140 are arranged generally in alignment so that the materials C1 and C2 can be dispensed onto a substrate for easy mixing. The difference in diameter in outlets 140 and 142 is to allow approximate equivalent velocity of exit of the materials C1 and C2.

A removable end cap 144 may be provided for closing the outlets 142 and 140.

Before the second container assembly 102 is attached to the first container 100, the integral cap 106 is cut from the reduced diameter portion 104 by a suitable knife or the like to gain access to the material C1 in the first container 100. The base 130, together with the second container 134 and outlet tube 132 is then screwed onto the reduced diameter portion 104 by virtue of the cooperating screw threads 105 and 139. Thus, the first container 100 and second container 134 are therefore coupled in head to tail arrangement with the first end 101 of the first container 100 being coupled to the second end 143 of the second container 134.

The first container 100 is preferably dimensioned so that it can be located in a conventional hand dispensing gun such as a caulking gun and with the second container assembly 102 projecting forwardly out of the conventional dispensing gun.

The hand gun is then operated so that a plunger 129 of the hand gun pushes piston 108 of the first container 100 away from second end 103 towards first end 101. This in turn forces the first material C1 to flow through the reduced diameter portion 104 into bore 131 and cavity 146, through outlet tube 132 to the first outlet 140. Movement of the piston 108 also moves the push rod 110 in the direction of arrow A in FIG. 1 so that the push rod 110 engages the end of the stem 151. The end of the stem 151 may be provided with a recess and the end 112 of the rod 110 may be pointed to engage within the recess to ensure engagement of the rod 110 with the stem 151. Furthermore, the engagement between the pointed end 112 of the rod 110 and the recess in the end of the stem 151 ensures that the rod 110 is maintained in alignment with the stem 151 so that the rod can pass through the hole 150 in the base 130 so that the rod smoothly passes into the hole 150 and second container 134 as the piston 136 is pushed to maintain the seal with the hole 150. Thus, as the piston 108 and push rod 110 move in the direction of arrow A, the second piston 136 is also pushed in the direction of arrow A so that the second material C2 is dispensed from the second outlet 142. Thus, both materials C1 and C2 are dispensed from the outlets 140 and 142 respectively so that they can then mixed and applied as required. The ratio of the volumes of C1 to C2 dispensed is determined by the diameter of the containers 100 and 134.

In view of the need to fill the outlet tube 132 before the first material C1 will flow from the first outlet 140, the push rod 110 could be spaced away from the stem 152 by a certain distance such that the piston 108 has moved a sufficient distance so that material C1 fills the outlet tube 132 before engagement of the push rod 110 with the stem 151. Thus, the outlet tube 132 will be filled with the material C1 so that material C1 and material C2 will be dispensed from the outlets 140 and 142 substantially at the same time during the first use of the dispenser.

The end 112 of the rod 110 is pointed and is received in a recess in the stem 151 to maintain alignment of the rod 100 as the rod moves through the second container 134.

The second container 134 includes a vent hole 138 to ensure no vapours of material C1 can leak past the piston 136 to contaminate the material C2 (or vice versa). Further, the vent hole 138 allows ingress of fresh equalising air behind the piston 136 as the piston 136 travels down the second container 134 towards the first end 141.

In the embodiment described above, the second container assembly 102 is formed by gluing the second container 134 and outlet tube 132 into the base 130. Alternatively, the entire assembly could be injection moulded as a single integral unit.

A second embodiment of the invention will be described, with reference to FIGS. 3 to 10. This embodiment relates to industrial applications rather than to hand gun type applications. In this embodiment the first container may have a capacity in the order of twenty liters.

Figure 3:
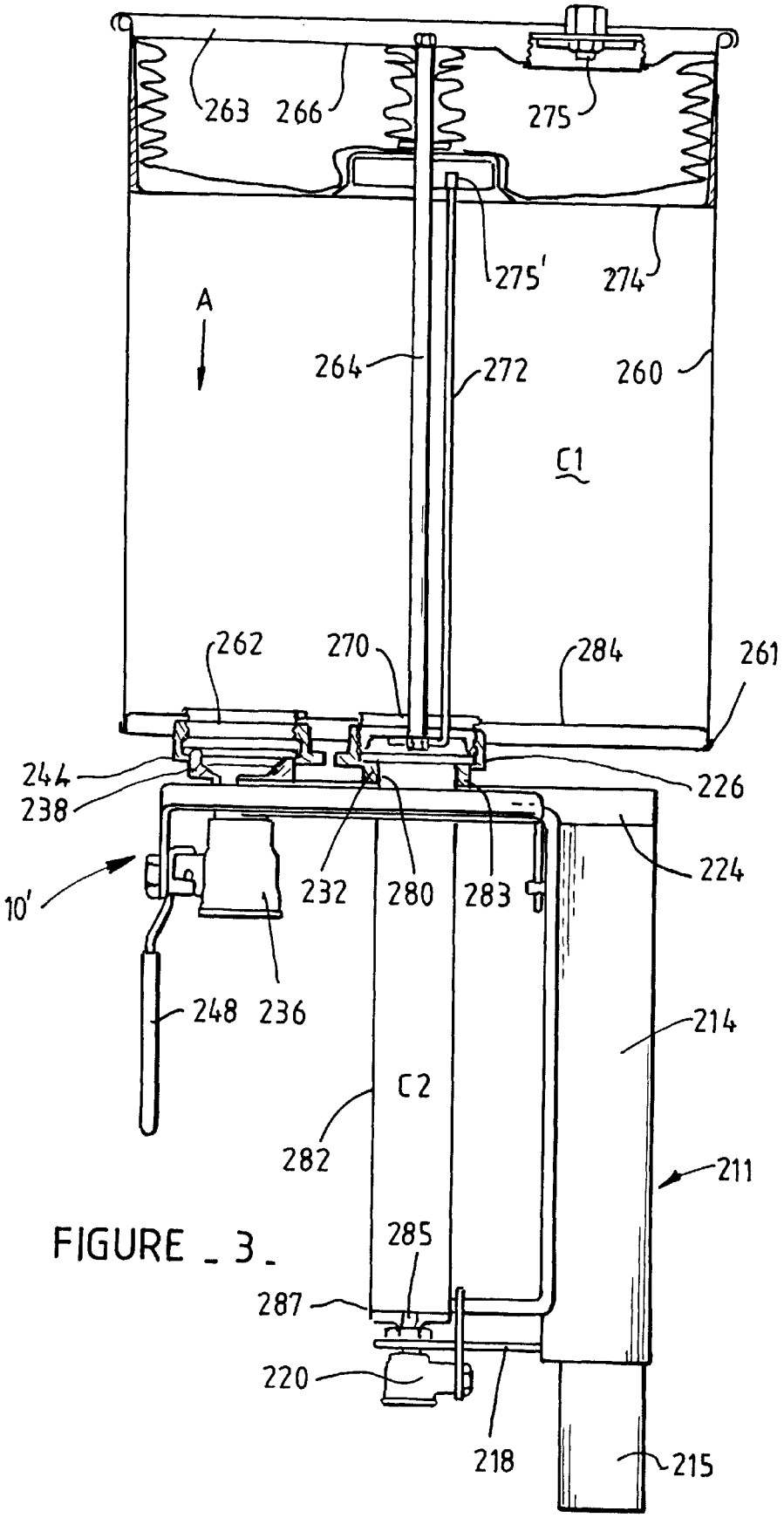
FIG. 3 is a view of a dispenser according to a second embodiment of the invention.
Figure 5:
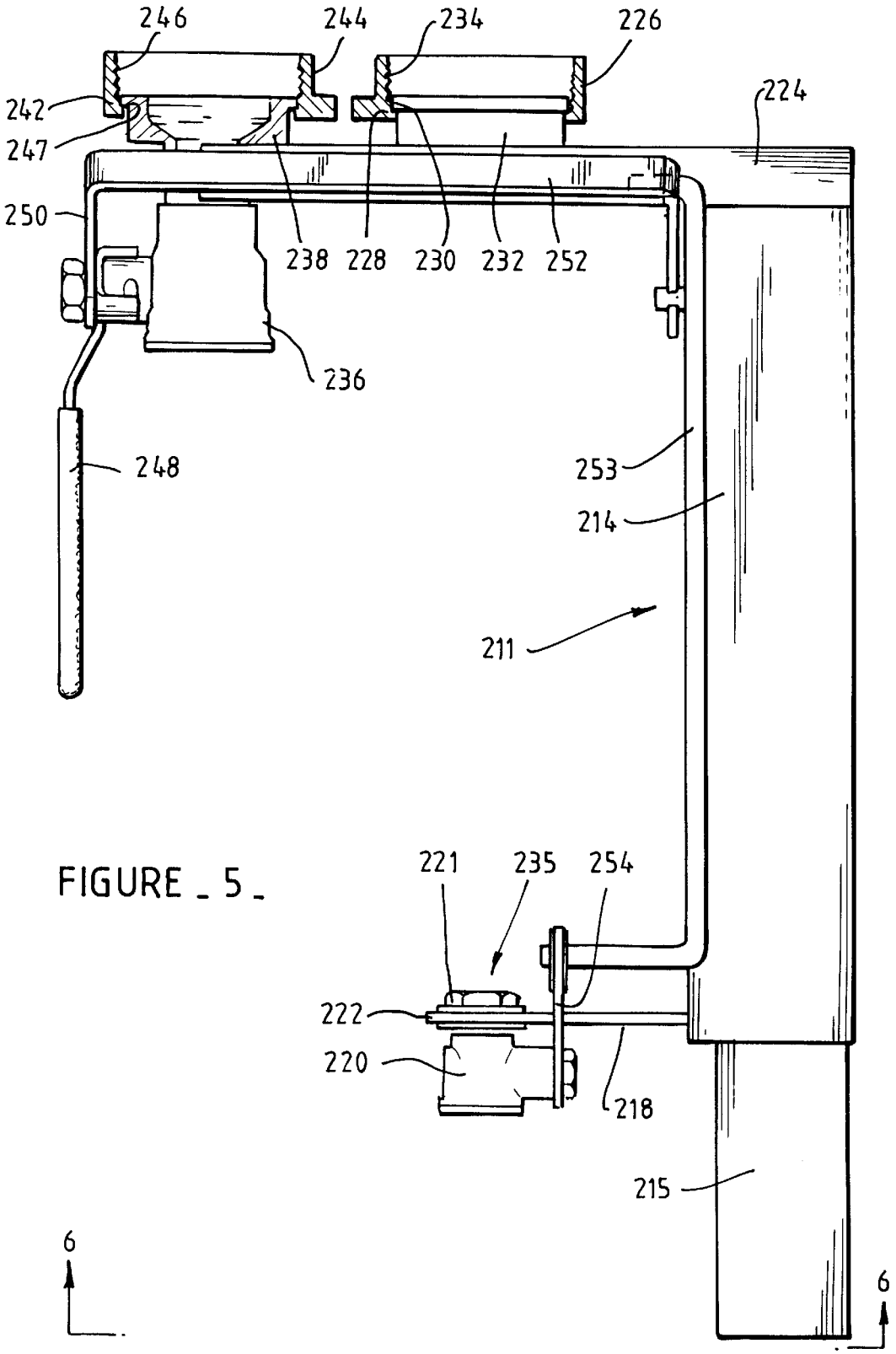
FIG. 5 is a view of a support frame used in the embodiment of FIG. 3.
Figure 7:
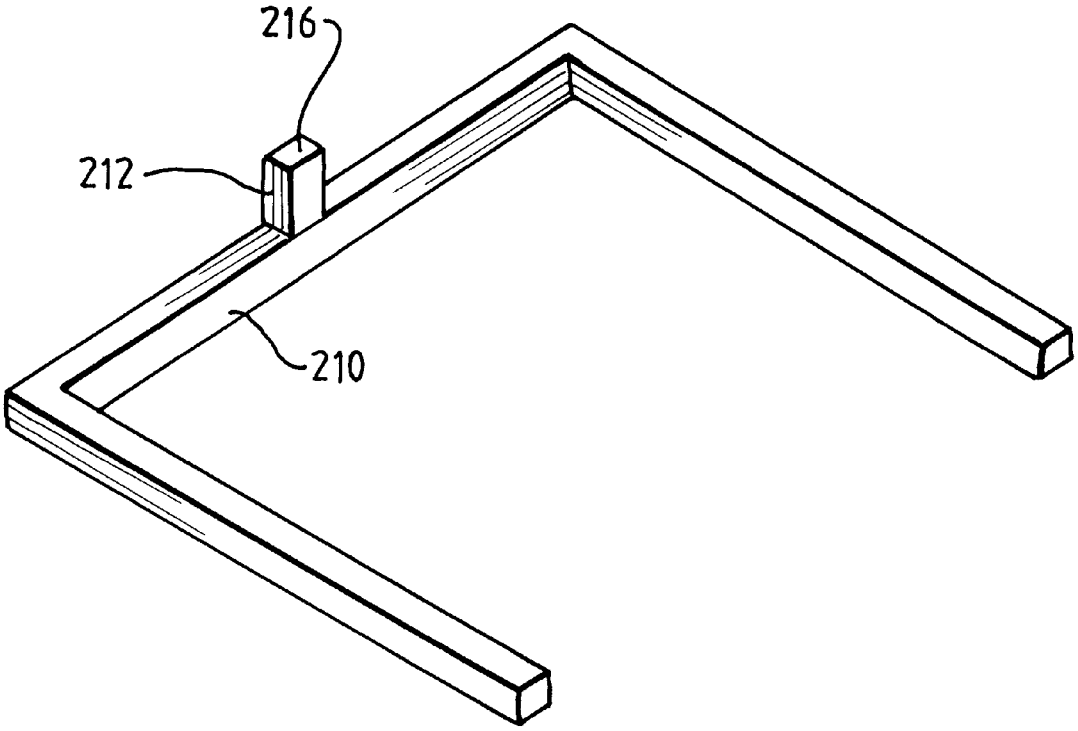
FIG. 7 is a view of a base for use with the support frame shown in FIG. 3 and FIG. 5.

With reference to FIG. 3, the dispenser 10' includes a stand 211 which has a base 210 (see FIG. 7). The base 210 has a tube 212 extending upwardly therefrom and a cavity 216 is provided within the tube 212. The stand 211 as is best seen in FIG. 5, has a vertical tube 214 with a smaller section 215 adapted to fit within the cavity 216 in the tube 212 so that the vertical tube 214 can be supported by the base 210 shown in FIG. 7. Alternatively, the vertical tube 214 could be bolted to a vertical wall or the like in a fashion well known in the art. A first container in the form of a pail 260 which contains a material C1 is intended to be coupled to the stand 211 and fixed relative to a second container in the form of a cartridge 282 as it contains a second material C2 and which is supported by the stand 211, as will be disclosed in more detail hereinafter.

Figure 6:
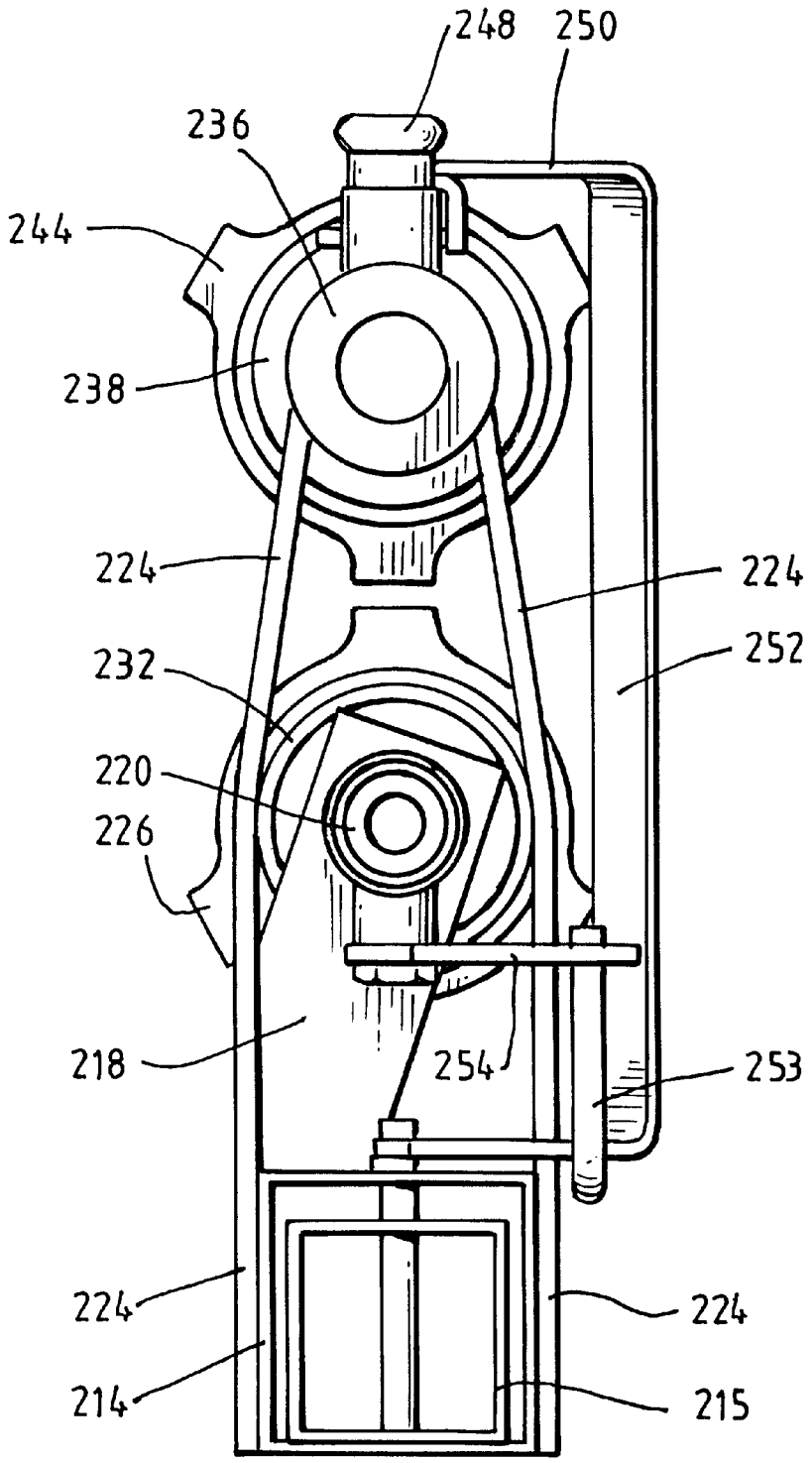
FIG. 6 is a view along the line VI—VI of FIG. 5.

As best seen in FIGS. 5 and 6, a support plate 218 is connected to the tube 214 and supports a valve 220 which is located in a hole 222 in the plate 218. Nut 221 secures the valve 220 in place in the hole 222. The valve 220 is of known design and therefore details will not be further described herein.

A pair of support bars 224 are coupled to the upper end of the tube 214. The bars 224 support a tubular guide 232 and a tubular guide 238. A valve 236 is attached to the tubular guide 238. Once again the valve 236 is of known design and will not be described in further detail. An internally screw threaded nut 226 is located on the tubular guide 232. The nut 226 has a flange 228 which engages behind a flange 230 of the guide 232 so that the nut 226 is trapped on the guide 232 but can rotate relative to the guide 232. The nut 226 includes internal screw threads 234.

The tubular guide 238 is attached to the valve 236 and an internally screw threaded nut 244 having internal screw thread 246 is arranged on the guide 238. The nut 244 has a flange 242 which engages behind a flange 247 on the guide 238 to trap the nut 244 in place but allow the nut 244 to rotate relative to the guide 238.

Figure 8:
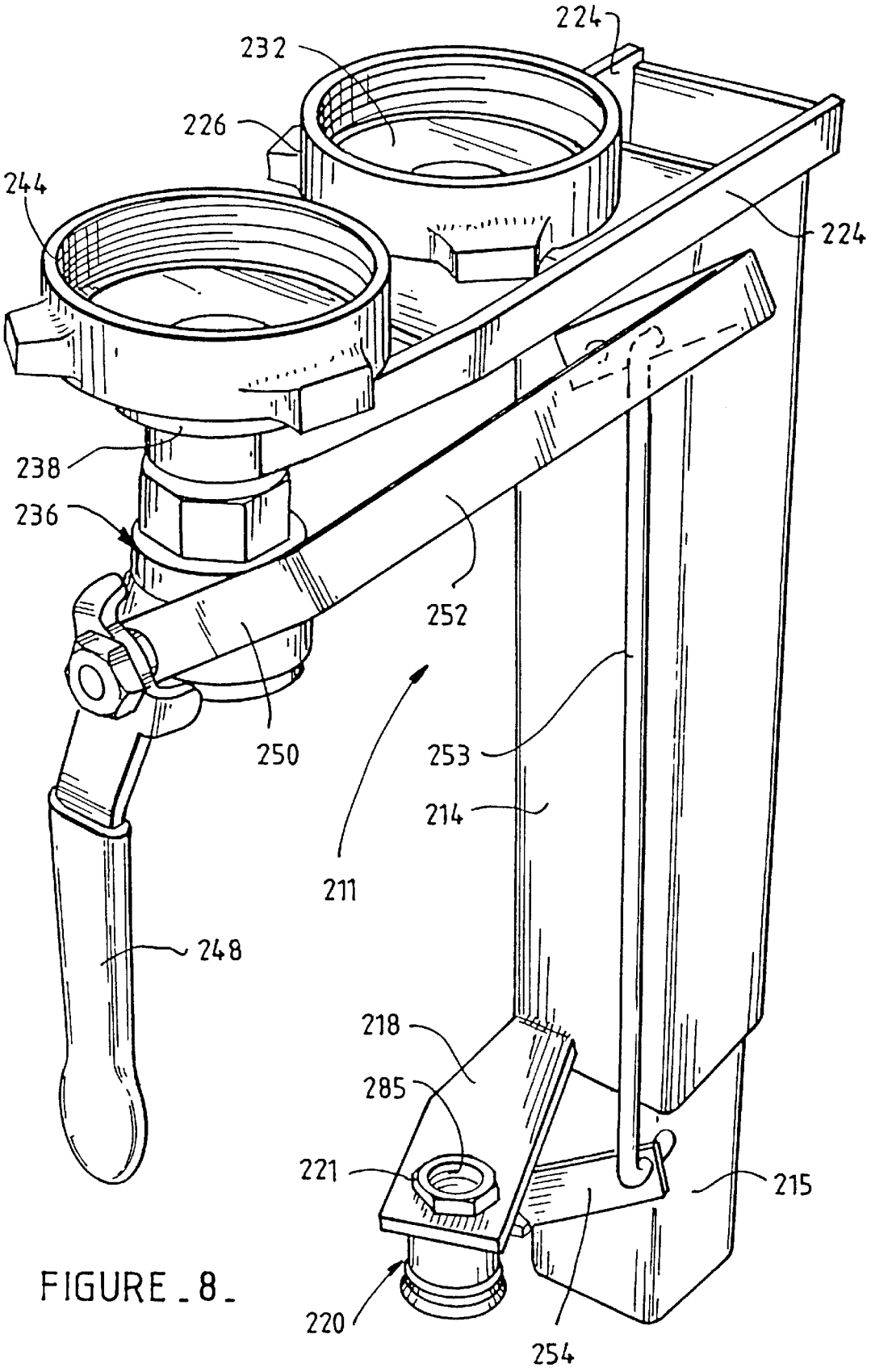
FIG. 8 is a perspective view of a stand shown in FIG. 3.

As is best seen in FIG. 8, the valve 236 has a handle 248 and an arm 250 which connects to a first linkage 252. First linkage 252 is connected to a second linkage 253 and the second linkage 253 connects to a second arm 254 which is attached to the valve 220. The handle 248, arm 250, linkage 252, linkage 253 and arm 254 enable both valves 236 and 220 to be opened and closed upon appropriate manipulation of the handle 248.

Figure 4:
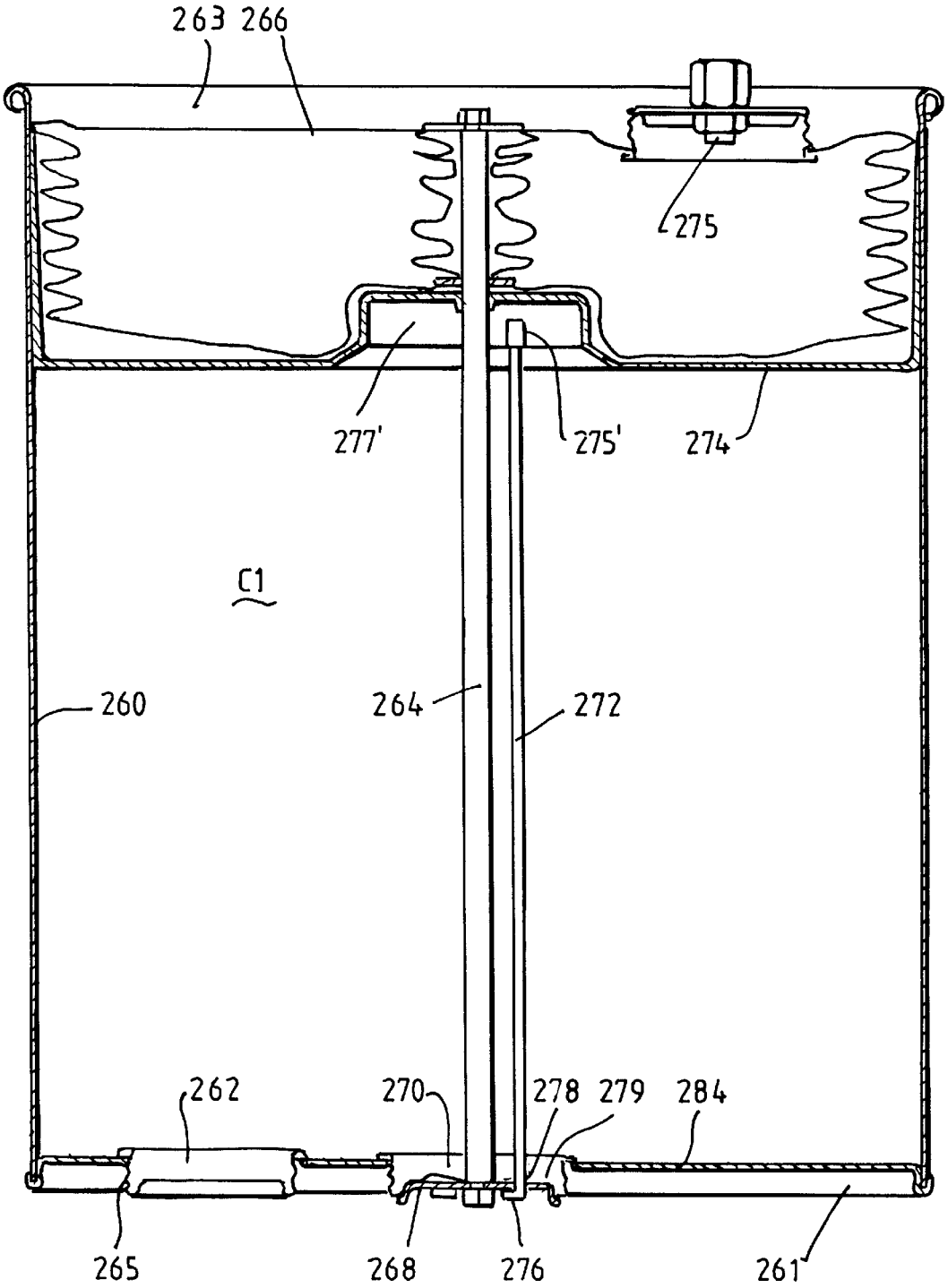
FIG. 4 is a view of one of the containers used in the embodiment of FIG. 3.

With reference to FIGS. 3 and 4, the pail 260 which has a capacity of, for example, 20 liters or the like, has a first end 261 and a second end 263. The first end 261 is provided with an outlet opening 262 which has an external screw thread 265. The pail 260 includes a piston 274 and a reinforcing rod 264 extends from the first end 261 to the second end 263 of the pail 260. The reinforcing rod 264 is connected to the lid 266 of the pail 260 and to a reinforcing plate 268 at the first end 261 of the pail 260. The plate 268 is located in what would normally be one of the outlet opening 270 from the pail 260. The outlet opening has an external screw thread 283'. For clarity conventional closure caps are not shown over outlet 262 and outlet opening 270 of FIG. 4. As will become apparent hereinafter, the outlet opening 270 is not used in the embodiment of this invention and the plate 268 not only acts to anchor the reinforcing rod 264 at the first end 261 but also to close off the opening 270. The reinforcing rod 264 prevents bowing of the lid 266 and a base 284 of the pail 260 when the pail 260 is pressurised by application of compressed air to compressed air inlet 275 so as to force the piston 274 to move away from the second end 263 towards the first end 261 and base 284. The use of the reinforcing rod 264 is more fully explained in our U.S. Pat. No. 5,305,929 and our co-pending International Patent Application No. PCT/AU92/00287. The contents of these specifications are incorporated into this specification by this reference.

Figure 10:
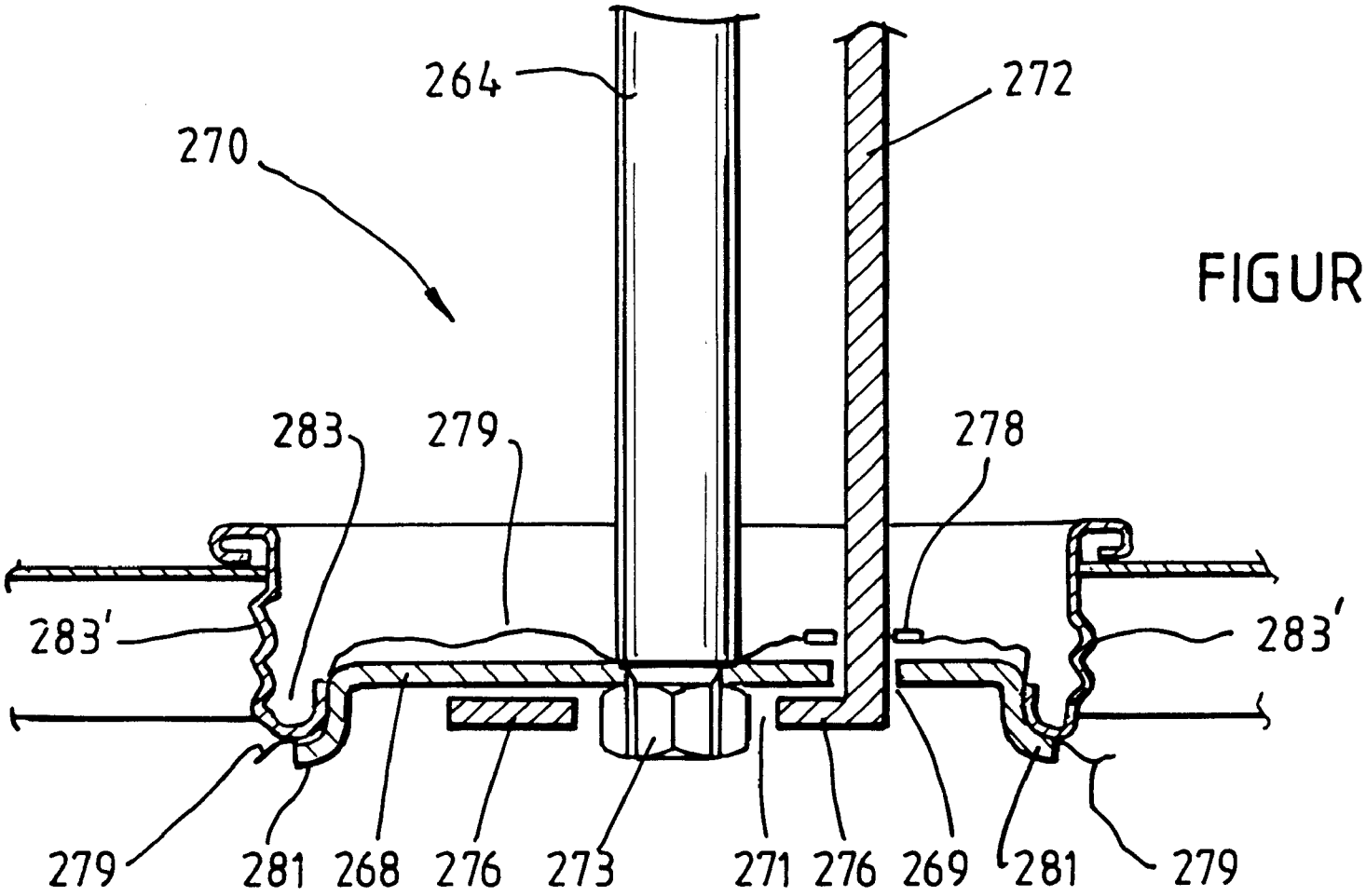
FIG. 10 is an enlarged view of part of FIG. 4.

A push rod 272 is arranged within the pail 260 and has one end abutting the piston 274 in a cavity 275' in a block 277' which forms part of the piston 274. The cavity 275' keeps the push rod 272 correctly aligned. As is best seen in FIG. 10, the other end 276 of the rod 272 extends through a seal 278 of a diaphragm 279 which is sandwiched between a flange 281 of the plate 268 and the wall 283 of the outlet 270. The seal 278 is similar in construction to the airtight seal of the air bag fully described in our co-pending International Patent Application No. PCT/AU92/00604. The specification of this international application is incorporated into this specification by this reference. The rod 272 also extends through a hole 269 in the plate 268 and into the space defined by the threaded outlet 270. The end 276 of the rod 272 is annular thus having a hole 271 to prevent fouling with the nut 273.

Figure 9:
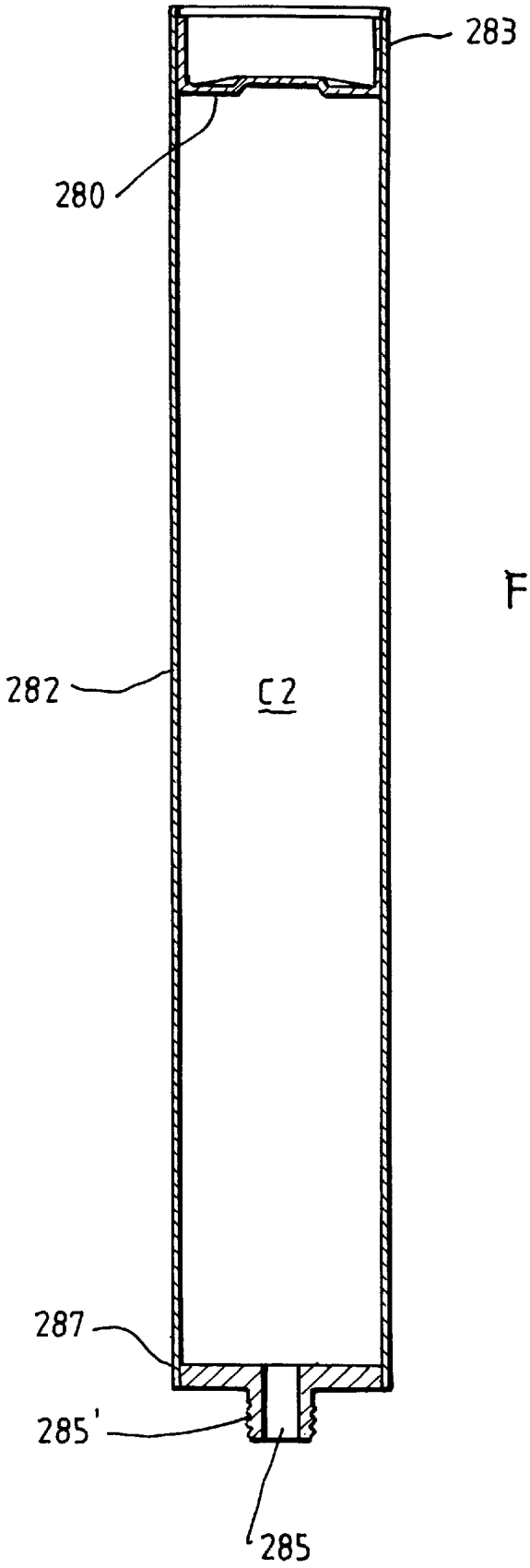
FIG. 9 is a view of a cartridge used in FIG. 3.

As best seen in FIG. 9, a second container 282 in the form of a cartridge is adapted to be located in the stand 211. The cartridge 282 contains a second material C2 and includes a piston 280 which in the initial position of the dispenser is adjacent a second end 283 of the cartridge 282. Outlet nozzle 285 is arranged at the first end 287 of the cartridge 282 and has a screw thread 285' for screw threaded engagement with internal screw thread 235 of the valve 220. The piston 280 can include a spacer (not shown) to allow a reduced initial gap between piston 238 and the push rod 272.

In order to use the dispenser according to the embodiments of FIGS. 3 to 10, the cartridge 282 is first located in the stand 211 by inserting the cartridge into the stand through the guide 232 so that the nozzle 285 is screwed into the valve 220 and the upper portion of the cartridge 282 is supported in the tubular guide 232 as shown in FIG. 3. The pail 260 can then be coupled to stand 211 using nuts 226 and 244.

The pail 260 is adapted to be connected to the valve 236 and cartridge 282 by arranging the pail 260 above the stand 211 as best shown in FIG. 3 and engaging the nut 244 with the external screw thread 265 on outlet 262 and by engaging the nut 226 with the external screw threads 283' on the opening 270. Thus, the pail 260 is connected in head to tail fashion with the cartridge 282 so that the first end 261 of the pail 260 is coupled by the stand 211 to the second end 283 of the cartridge 282. The outlet of the pail 260 is coupled with the valve 236.

The push rod 272 which passes through the diaphragm 279 and plate 268 enters the cartridge 282 and is arranged adjacent to the piston 280 in the cartridge 282.

In order to dispense the materials C1 and C2 from the pail 260 and cartridge 282 compressed air is supplied to inlet 275 to force piston 274 in the direction of arrow A away from second end 263 towards the first end 261 and base 284. Movement of the piston 274 also moves the push rod 272 so the push rod 272 engages the piston 280 and pushes the piston also in the direction of arrow A away from the second end 283 of the cartridge 282. Thus, when the handle 248 is manipulated to open the valves 236 and 220, the material C1 is able to pass through the outlet 262 and valve 236 and material C2 is able to pass through the outlet nozzle 285 and valve 220 onto a suitable substrate which is located below the valves 236 and 220 so that the materials C1 and C2 can be mixed and applied as required.

Since modifications within the spirit and scope of the invention may readily be effected by persons skilled within the art, it is to be understood that this invention is not limited to the particular embodiments described by way of example hereinabove.

We claim:

1. A dispenser, including:

a first container for containing a first material, the first container having a side wall and the first material being in contact with the side wall, a first end on the first container;

a first piston arranged in the first container for movement towards the first end for dispensing the first material from the container;

a second container for containing a second material, a second end on the second container;

a second piston arranged in the second container for movement away from the second end for dispensing the second material from the second container, the second container being arranged relative to the first container such that the second end is in the proximity of and fixed relative to the first end; and an interengaging means arranged between the first and second pistons such that when the first or second piston is moved, the other of the second or first piston is moved by the interengaging means in a fixed relationship with respect to the first or second piston.

2. A dispenser according to claim 1 wherein the interengaging means is separate from at least the second piston and abuts the second piston and pushes the second piston to move the second piston.

3. The dispenser of claim 1 wherein the second container is of smaller diameter than the first container and the first container being dimensioned to fit within a hand dispenser gun so that an actuator of the hand dispenser gun can push the first piston towards the first end of the first container to, in turn, cause the interengaging means to push the second piston in the second container away from the second end of the second container to dispense the first material from the first container and the second material from the second container.

4. The dispenser of claim 1 wherein the interengaging means comprises a rod between the first and second pistons.

5. A dispenser including:

a first container for containing a first material, the first container having a first end and a second end;

a first outlet from the first container;

a piston in the first container for movement away from the second end and towards the first end to dispense the first component from the first container through said first outlet;

a push member coupled to the first container and moveable relative to the first container when the first piston is moved away from the second end towards the first end;

a second container for containing a second material, the second container having a first end and a second end;

a second outlet from the second container;

a second piston in the second container for movement away from the second end of the second container and towards the first end of the second container to dispense the second material from the second container through said second outlet, the second piston being separate from the first piston and the push member;

a coupling means at the first end of the first container or second end of the second container for engaging another coupling means so that the first and second containers can be held in a head to tail arrangement so that when the first piston is moved and the push member is moved, the push member can engage the second piston to move the second piston so that the first and second materials are dispensed from the dispenser.

6. The dispenser of claim 5 wherein the coupling means is a first coupling means at the first end of the first container, and the said another coupling means is included in a stand for supporting the dispenser so that the another coupling means and first coupling means cooperate to couple the first and second container in head to tail arrangement.

7. The dispenser of claim 5 wherein an outlet tube is coupled to the second container, the outlet tube having first and second ends, the first end of the outlet tube having said first outlet for enabling dispensing of the first material, the second end of the outlet tube having an inlet opening for communication with the first container so that the first material can pass from the first container into the inlet opening, through the outlet tube and out of the first outlet.

8. The dispenser of claim 5 wherein the second outlet of the second container is arranged at the first end of the second container.

9. The dispenser of claim 5 wherein the first and second outlets are substantially aligned with one another so that the first and second materials can be dispensed from the first and second outlets onto a substrate and mixed together.

10. The dispenser of claim 5 wherein the dispenser includes a stand having a first valve for connection with the first outlet, the stand being for supporting the second container and holding the second container fixed relative to the first container, the stand having a second valve for communication with the second outlet.

11. The dispenser of claim 10 wherein the coupling means comprises a screw thread on the first container and the another coupling means comprises a screw threaded nut on the stand, the screw threaded nut being for engaging the screw thread of the first container to couple the first container and second container together in head to tail arrangement.

12. The dispenser of claim 5 wherein the coupling means is a first coupling means at the first end of the first container, and the said another coupling means is a second co-operating coupling means at the second end of the second container.

13. The dispenser of claim 12 wherein the first coupling means comprises a screw thread at the first end of the first container and the second coupling means comprises a co-operating screw thread at the second end of the second container for screw thread engagement with the first screw thread to thereby couple the first and second containers in head to tail arrangement.

14. The dispenser according to claim 12 wherein the second container is included in a second container assembly which comprises the second container, an outlet tube and a base member connected to both the second container and the outlet tube, the base member containing a screw threaded bore which forms the second cooperating coupling means and which is axially aligned with the second container for enabling coupling of the second container to the first container, and wherein the outlet tube communicates with a cavity in the base which in turn communicates with the bore to allow flow of the first material from the first container through the base of the second container assembly to the outlet tube, and wherein the second piston has a stem which passes through an opening in the base for engagement by the push rod so that the push rod can push the second piston and wherein the opening is dimensioned such that a seal is formed between the base and the push rod and stem to prevent the first material from contacting the second material in the second container.

15. A first container for a dual material dispenser including a second container for containing a second material, the second container having a second piston, the first container including:

a container body for containing a first material, the container body having a first end, a second end, a base at the first end, and a side wall, and wherein the first material is in contact with the side wall;

a first outlet from the container body;

a first piston in the container body for movement away from the second end and towards the first end to dispense the first component from the container body through said first outlet;

a push member engagable with the first piston and movable relative to the container body in the same direction as the first piston when the first piston is moved away from the second end towards the first end; and wherein the container is fixable relative to a second container in a head to tail arrangement so that when the first piston is moved and the push member is moved, the push member can engage the second piston in the second container to move the second piston in the same direction as the first piston so that the first and second materials are dispensed from the first and second containers.

16. A second container for a dual dispenser including a first container for containing a first material, a first piston, a push member for movement with the first piston and a first outlet, the second container including:

a second container body for containing a second material, the container body having a first end and a second end;

a second outlet for the second container body, the second outlet being at the first end of the second container body;

a second piston in the second container body for movement away from the second end and towards the first end to dispenser the second material through the second outlet; and coupling means at the second end of the second container body for coupling the second container body to the first container in head to tail arrangement so that when the push member is moved with the first piston in the first container, the push member can engage the second piston to move the second piston so the first and second materials are dispensed from the first container and second container.

17. The second container according to claim 16, wherein an alignment means is coupled to the second container body for movement in the second container body, the alignment means being engagable by the push member and movable with the push member to maintain alignment of the push member in the second container body.

18. A container for a dual material dispenser, including:

a container body for containing a first material, the container body having a first end, and a second end;

a first outlet from the container body;

a piston in the container body for movement away from the second end and towards the first end to dispense the first component from the container body through said first outlet;

alignment means for receiving a push member to maintain the push member in alignment substantially with the direction of movement of the piston; and wherein the container is fixable relative to a second container, for containing a second material, in a head to tail arrangement so that when the first piston is moved the push member is held in alignment by the alignment means.

19. A container for containing one material, for use in a dual material dispenser including another container for containing another material, the another container having another piston and another outlet, the container including:

a container body for containing the material, the container body having a first end and a second end;

an outlet from the container body;

a piston in the container body for movement away from the second end and towards the first end to dispense the material from the container body through said outlet;

a push member moveable relative to the container body when the piston is moved away from the second end towards the first end; and wherein the container is fixable relative to the another container in a head to tail arrangement so that the piston, the push member and the another piston can be moved together to dispense said one material and the another material from the container and the another container.

20. The container according to claim 19 wherein when the container and said another container are coupled in the head to tail arrangement, the push member is sandwiched between the piston and the another piston so that when one of the said piston and said another piston is moved, the push rod causes the other of the piston and said another piston to move to dispense the one material and said another material from the container and the another container.

21. An attachment member for joining a first container to a second container in a head to tail arrangement, the first container having a first piston for dispensing a first material from the first container and the second containing having a second piston for dispensing a second material from the second container, the attachment member including:

a body portion;

connection means on the body portion for coupling the attachment member to the first container;

a bore through the body portion for receiving a push member which is movable by engagement with the first piston in the first container and which is engageable with the second piston in the second container; and an outlet in the body portion communicating with the bore for dispensing of the first material from the first container.

22. The attachment member according to claim 21 wherein the bore has a first large diameter portion which communicates with the outlet and a second small diameter portion for sealingly receiving the push member.

23. The attachment member according to claim 21 wherein the attachment member is integrally coupled to the second container.

24. A second container for a dual material dispenser which includes the second container and a first container which are coupleable in head to tail arrangement with respect to one another, the first container having a first piston for dispensing a first material through a first outlet in the first container, the second container including:

a container body for containing a second material, the container body having a first end and a second end;

a second outlet from the container body;

a second piston in the container body for movement away from the second end and towards the first end to dispense the second component from the container body through said second outlet; and seal means for receiving a push member to enable the push member to enter the container body and move the second piston whilst preventing entry of the first material from the first container into the container body.

25. The container according to claim 24 wherein the seal means comprises a bore in the container body which is dimensioned to tightly fit and receive the push member so that the tight fit creates a seal between the container body and the push member to thereby prevent the entry of material from the first container into the container body.

* * * * *